US010272482B2

(12) United States Patent
Frenken et al.

(10) Patent No.: US 10,272,482 B2
(45) Date of Patent: Apr. 30, 2019

(54) PIVOTING JAW AND MOTOR-ACTUABLE HANDHELD APPARATUS

(71) Applicants: GUSTAV KLAUKE GMBH, Remscheid (DE); Greenlee Textron Inc., Rockford, IL (US)

(72) Inventors: Egbert Frenken, Heinsberg (DE); Gerald Tully, Wuppertal (DE)

(73) Assignees: GUSTAV KLAUKE GMBH, Remscheid (DE); GREENLEE TOOLS, INC., Rockford, IL (US)

( * ) Notice: Subject to any disclaimer, the term of this patent is extended or adjusted under 35 U.S.C. 154(b) by 826 days.

(21) Appl. No.: 14/269,716

(22) Filed: May 5, 2014

(65) Prior Publication Data

US 2015/0151348 A1 Jun. 4, 2015

(30) Foreign Application Priority Data

Dec. 3, 2013 (DE) ..... 10 2013 113 359
Mar. 5, 2014 (DE) ..... 10 2014 102 932

(51) Int. Cl.
*B21D 28/26* (2006.01)
*B21D 28/34* (2006.01)
*B26F 1/34* (2006.01)

(52) U.S. Cl.
CPC ..... *B21D 28/34* (2013.01); *B26F 1/34* (2013.01); *B21D 28/26* (2013.01)

(58) Field of Classification Search
CPC ..... B21D 28/34; B21D 28/26; B26F 1/34
See application file for complete search history.

(56) References Cited

U.S. PATENT DOCUMENTS 1,640,883 A * 8/1927 Coleman ..... B25B 7/02 12/103
2,844,978 A * 7/1958 Hunter ..... B21J 15/105 173/170
4,171,616 A * 10/1979 Keigley ..... B25B 7/126 30/180
4,625,386 A * 12/1986 Bieganski ..... H01R 43/0421 29/33 M
4,868,986 A * 9/1989 Olson ..... B25B 5/103 29/261

(Continued)

FOREIGN PATENT DOCUMENTS

DE 202010008228 U1 1/2012
GB 145242 7/1920

(Continued)

OTHER PUBLICATIONS

European Examination Report in connection with European Patent Application No. EP 14 19 5565 dated Mar. 24, 2015, 7 pages.

*Primary Examiner* — Kenneth E Peterson
*Assistant Examiner* — Liang Dong
(74) *Attorney, Agent, or Firm* — Klintworth & Rozenblat IP LLP

(57) ABSTRACT

An assembly includes a first punching jaw, a second punching jaw pivotally connected to the first punching jaw, a punching stamp provided on one of the punching jaws and a punching opening provided on the other of the punching jaws, and a handheld apparatus connected to the jaws. When said handheld apparatus is actuated, the first ends of the jaws move toward each other to effect a punching process.

17 Claims, 12 Drawing Sheets

(56) References Cited

U.S. PATENT DOCUMENTS

| | | | | |
|---|---|---|---|---|
| 6,141,876 | A * | 11/2000 | Hamm | B23D 21/06 30/100 |
| 6,314,842 | B1 * | 11/2001 | Hsieh | B25B 13/14 81/129 |
| 7,144,049 | B2 * | 12/2006 | Stangeland | F16L 27/1012 285/261 |
| 7,913,400 | B2 * | 3/2011 | Larkin | B26B 17/02 30/187 |
| 8,001,872 | B2 * | 8/2011 | Gorrie | B67B 7/18 269/3 |
| 2007/0180887 | A1 | 8/2007 | Frenken | |
| 2012/0260491 | A1 * | 10/2012 | Draht | B21D 39/03 29/525.06 |

FOREIGN PATENT DOCUMENTS

| | | | |
|---|---|---|---|
| JP | H06 254632 | | 9/1994 |
| WO | 2003/084719 | A2 | 10/2003 |
| WO | 2012/080293 | A2 | 6/2012 |
| WO | 2013/017535 | A2 | 2/2013 |

* cited by examiner

III
23
1
16
11
26
28
8
19
12
27
25
III
19
20
13
9
14
L2
10
15
L1
III
4
L3
5
7
6
2
III
37
22
3

PIVOTING JAW AND MOTOR-ACTUABLE HANDHELD APPARATUS

FIELD OF THE INVENTION

The invention relates firstly to punching jaws, which can be connected to a preferably hydraulically or pneumatically actuable handheld apparatus and which are connected for pivoting in a pivot plane about a common pivot axis and which are in the form of pivoting jaws, for punching out holes and/or recesses in, preferably, sheet-metal parts, wherein, as a working region, a punching stamp is formed on a first pivoting jaw and a punching opening is formed on the second pivoting jaw, wherein furthermore, regions of action of the pivoting jaws can be acted on, in order for a punching process to be performed, by means of action in the form of a fixed part and a moving part, in particular of a hydraulically or pneumatically actuated piston/cylinder arrangement.

The invention furthermore relates to a motor-actuable handheld apparatus having a grip region and having pivoting jaws which are arranged for pivoting about a common pivot axis configured as a first axis and which are if appropriate in the form of punching jaws, wherein furthermore, regions of action of the pivoting jaws can be acted on, in order for a pivoting movement to be performed, along an axis of action by means of action in the form of a fixed part and a moving part, wherein the means of action may have in particular a hydraulically or pneumatically actuated piston/cylinder arrangement.

BACKGROUND OF THE INVENTION

Pivoting jaws of said type, also in the form of punching jaws, and furthermore pivoting jaws arranged on a motor-actuable handheld apparatus, are already known from WO 2013/017535 A2. It is also known, cf. DE 202010008228 U1, for a motor-actuable handheld apparatus to have formed thereon a tension piston which is arranged pivotably with apparatus. Not least, it is respect to the handheld known, cf. WO 2012/080293 A2 (AU 2011343379 A1), in the case of a motor-actuable handheld apparatus, for holes to be punched out of a sheet-metal part by means of a tension piston.

SUMMARY OF THE INVENTION

Taking the stated prior art as a starting point, the invention is concerned with the problem of specifying punching jaws which are in the form of pivoting jaws and which can be actuated in an expedient manner. Furthermore, the invention is concerned with the problem of specifying a motor-actuable handheld apparatus with pivoting jaws arranged thereon, which handheld apparatus is as versatile as possible in terms of use.

One possible solution to the problem is provided, according to a first concept of the invention, in the case of a punching jaw pair in which the regions of action of the punching jaws can be moved toward one another in order for a punching process to be performed. By virtue of the fact that, in the case of a pivoting jaw pair in the form of a punching jaw pair, the regions of action can be moved toward one another in order for a punching process to be performed, it is possible to realize a very space-saving arrangement with regard to an apparatus that actuates the pivoting jaws. The means of action need not engage on the pivoting jaws in the same way at both sides of the pivoting jaws as viewed in a pivoting plane of the pivoting jaws.

Accordingly, it is made possible for the means of action and the associated apparatus to engage substantially on one side with respect to the pivoting jaws, wherein the means of action and possibly the apparatus that actuates these may be arranged so as to extend in the pivoting direction of the pivoting jaws.

The means of action and if appropriate also the apparatus that actuates these may be arranged so as to run substantially at right angles to a direction of extent of the pivoting jaws.

A further possible solution to the problem, with regard to the motor-actuable handheld apparatus, is provided according to a further concept of the invention in that the pivoting jaws are jointly rotatable, about a further axis which differs from the axis of action and the pivot axis, relative to the grip region of the handheld apparatus, which grip region is to be regarded as static. Thus, with regard to pivoting jaws and in particular punching jaws, a high level of variability of the arrangement is achieved with regard to the grip region of the handheld apparatus. Even in regions that are difficult to access, it is still possible to carry out a necessary working process using the pivoting jaws, if appropriate also in the form of punching jaws.

The pivoting jaws suitable handheld may basically be connected to any apparatus. The handheld apparatus preferably has a tension part, corresponding for example to a tension piston in the case of a hydraulic or pneumatic apparatus. Here, it is also possible for the tension part to be actuated exclusively by electric motor. Furthermore, the handheld apparatus preferably has a part which, in the context claimed and described here, serves as a counter bearing.

Accordingly, it is preferable for the pivoting jaws, in particular also in the specific embodiment thereof as punching jaws, to extend so as to cross one another. This relates to the pivoting jaws with regard to their longitudinal extent, wherein said pivoting jaws, at one side, have working regions, and at the other side, in front of or behind the crossing region as viewed from the working regions, have regions of action for the means of action.

In particular, it is also preferable, for interaction with a means of action, for the pivoting jaws to have openings which are oriented toward one another and the orientation of which corresponds to the extent of the pivot plane. It is thus possible for a means of action to engage into a pivoting jaw and if appropriate extend through the same. Said orientation in the pivoting plane permits the stated orientation of the means of action, and if appropriate in particular of the associated handheld apparatus, substantially in an extent at right angles with respect to a longitudinal extent of the pivoting jaws themselves.

It is also preferable for the means of action to act on the pivoting jaws between the working regions and the pivot axis as viewed in relation to the already discussed longitudinal extent of the pivoting jaws. This action configuration is indeed ostensibly not very expedient from a force aspect because no lever action can be utilized. On the other hand, however, with regard to the longitudinal extent of the pivoting jaws, said action configuration allows the pivoting jaws to be of relatively short design. This may have an expedient effect with regard to the on-site machining of poorly accessible installed objects, such as is often required specifically when carrying out punching processes, for example.

The means of action may in particular have a piston rod which extends through both pivoting jaws. Here, with regard to a first pivoting jaw, the piston rod is configured so as to extend through so as to project at one side toward the other pivoting jaw and at the other side toward the handheld apparatus. With regard to the second pivoting jaw, the piston rod may extend through the latter merely for fastening purposes, or may be fixedly connected at least to said second pivoting jaw without extending all the way through.

In order to perform a working process, the fixed part of the means of action, said fixed part preferably being a part of the handheld apparatus, interacts, preferably as counter bracket, with one of the pivoting jaws. During the preferred pulling of the pivoting jaws, or of pivoting jaw sections, toward one another by the handheld apparatus, the moving part, which may for example be in the form of a hydraulic or pneumatic piston, moves relative to the fixed part which bears firmly, as counter bracket, against one of the pivoting jaws.

The pivoting jaws may themselves be pre-loaded into their initial position, that is to say the open position before a working process, by means of a restoring spring. Here, if the means of action are preferably permanently connected to the pivoting jaws, the restoring spring may be arranged so as to surround the piston rod. Alternatively, the restoring spring may for example also be arranged in the region of a joint or crossing point of the pivoting jaws so as to force the pivoting jaws toward one another relative to the pivot axis.

In a further detail, the fixed part in the form of a counter bracket may act via a spherical-cap section on a suitably concavely formed action section of the associated pivoting jaw so as to realize an articulated movement capability. Owing to the fact that the regions of action of the pivoting jaws move toward one another, in principle, on circular arcs, a certain degree of mobility of the means of action relative to the pivoting jaws is advantageous if, as is preferable here, the means of action are composed substantially of a piston rod and a counter bracket. The movement capability may be realized in an expedient manner by means of the stated spherical-cap/concave design. Here, it may conversely also be provided that the spherical-cap section is formed on a pivoting jaw and the concavely formed action section is formed on the fixed part.

Furthermore, it is also preferable for the pivoting jaws to be of different design, wherein one of the pivoting jaws, in the case of punching jaws preferably the pivoting jaw that has the punching stamp, runs in an angular configuration as seen in a side view.

BRIEF DESCRIPTION OF THE DRAWINGS

The invention will be explained in more detail below on the basis of the appended drawing, which however illustrates merely exemplary embodiments.

In the drawings:

FIG. 7 is a further illustration as per FIG. 5 and FIG. 6, after the punching stamp has been moved downward;

DETAILED DESCRIPTION OF THE ILLUSTRATED EMBODIMENTS

Figure 1:
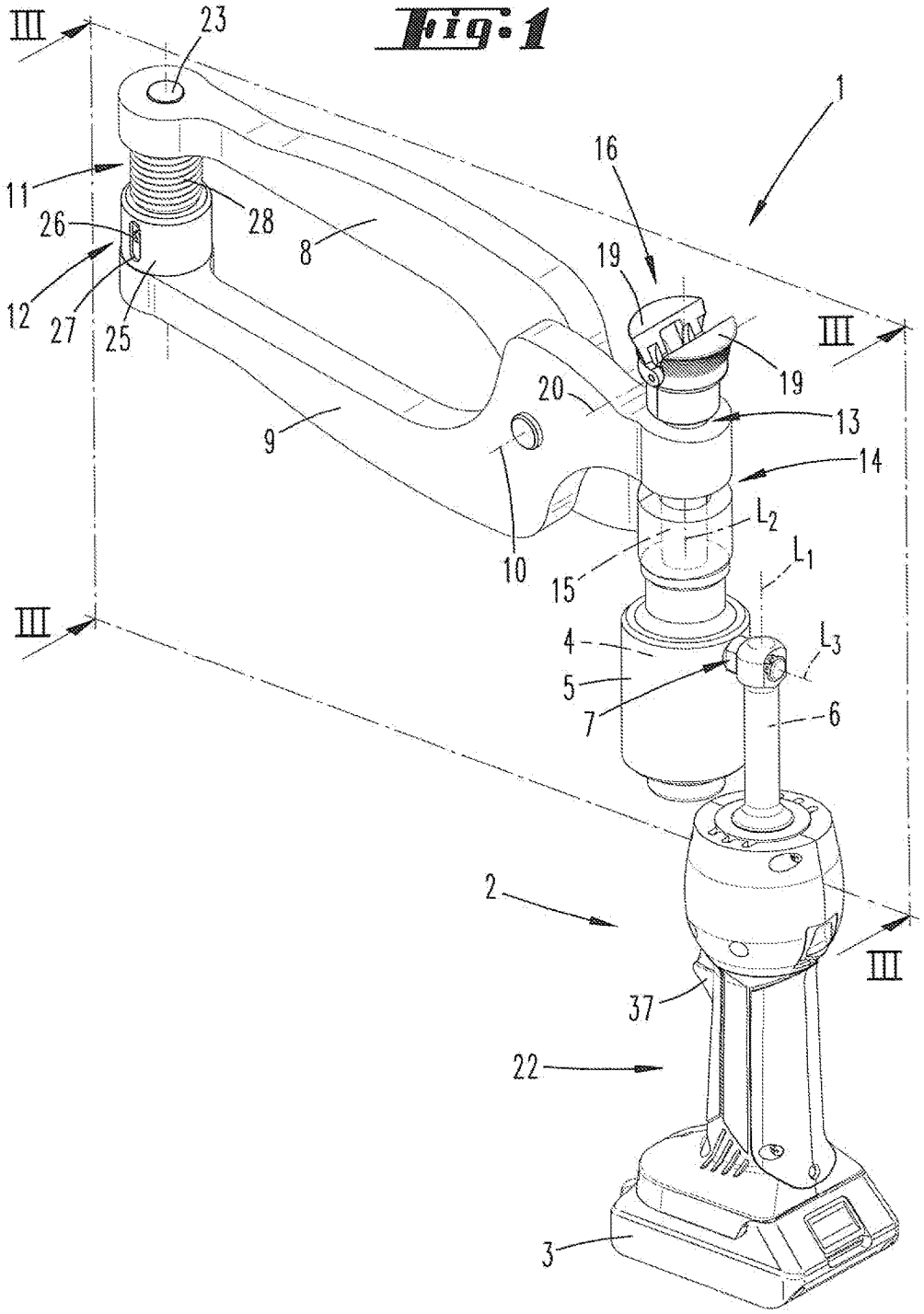
FIG. 1 shows perspective overall view of a handheld apparatus connected to pivoting jaws in the form of punching jaws.
Figure 2:
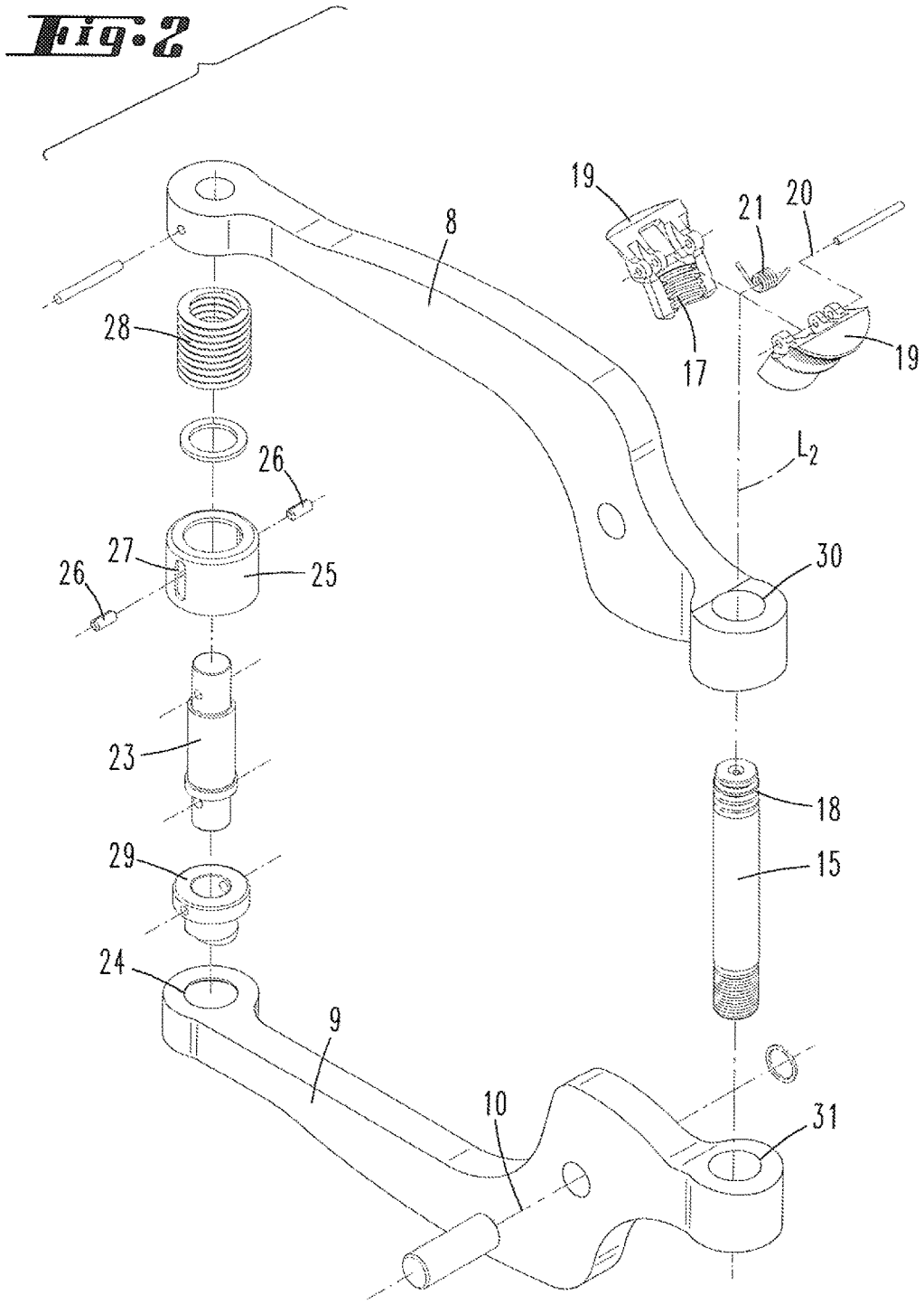
FIG. 2 shows the pivoting jaws as per FIG. 1 in an exploded illustration.
Figure 3:
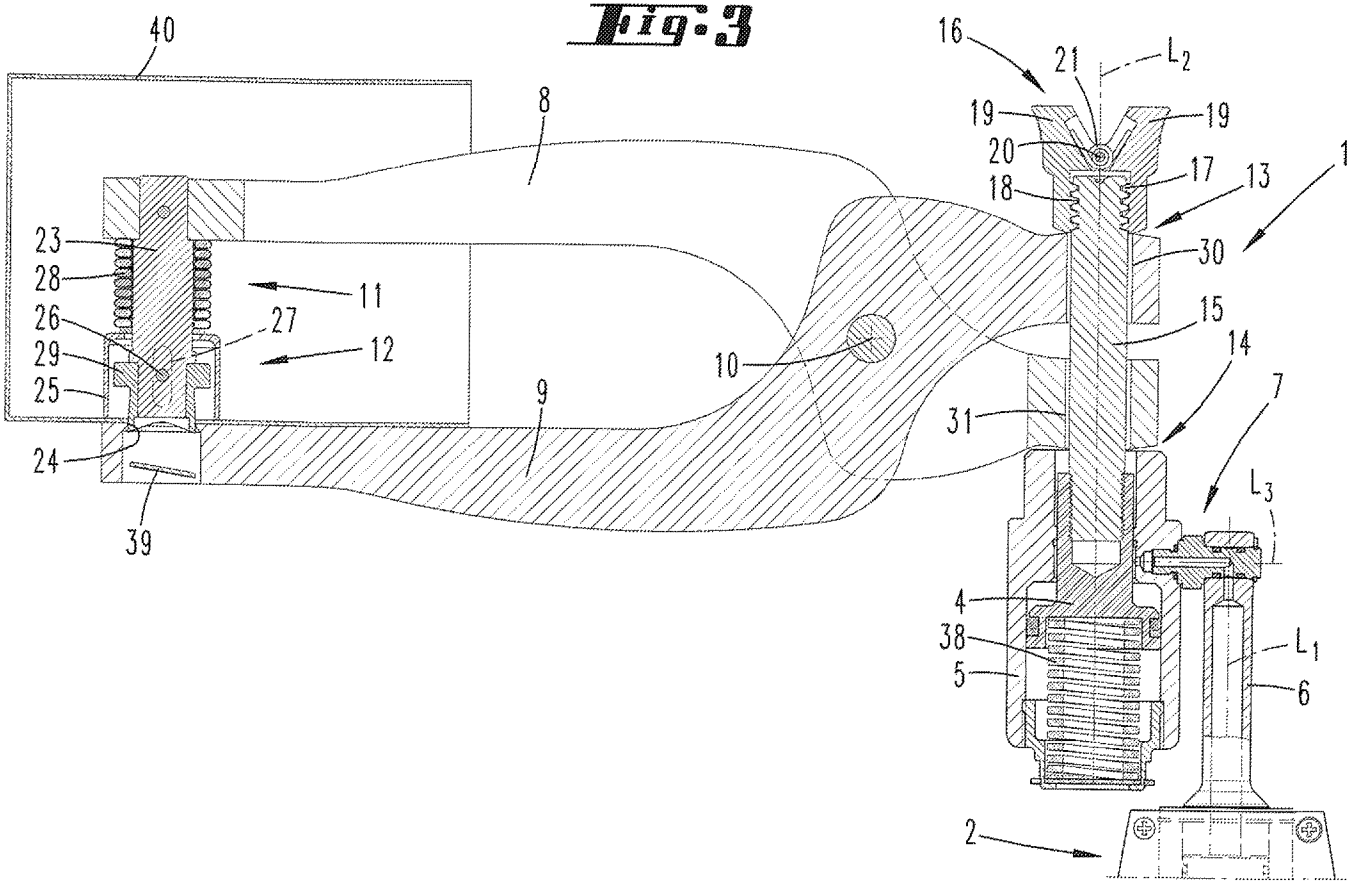
FIG. 3 shows a cross-section through region of FIG. 1, sectioned in III-III.
Figure 4:
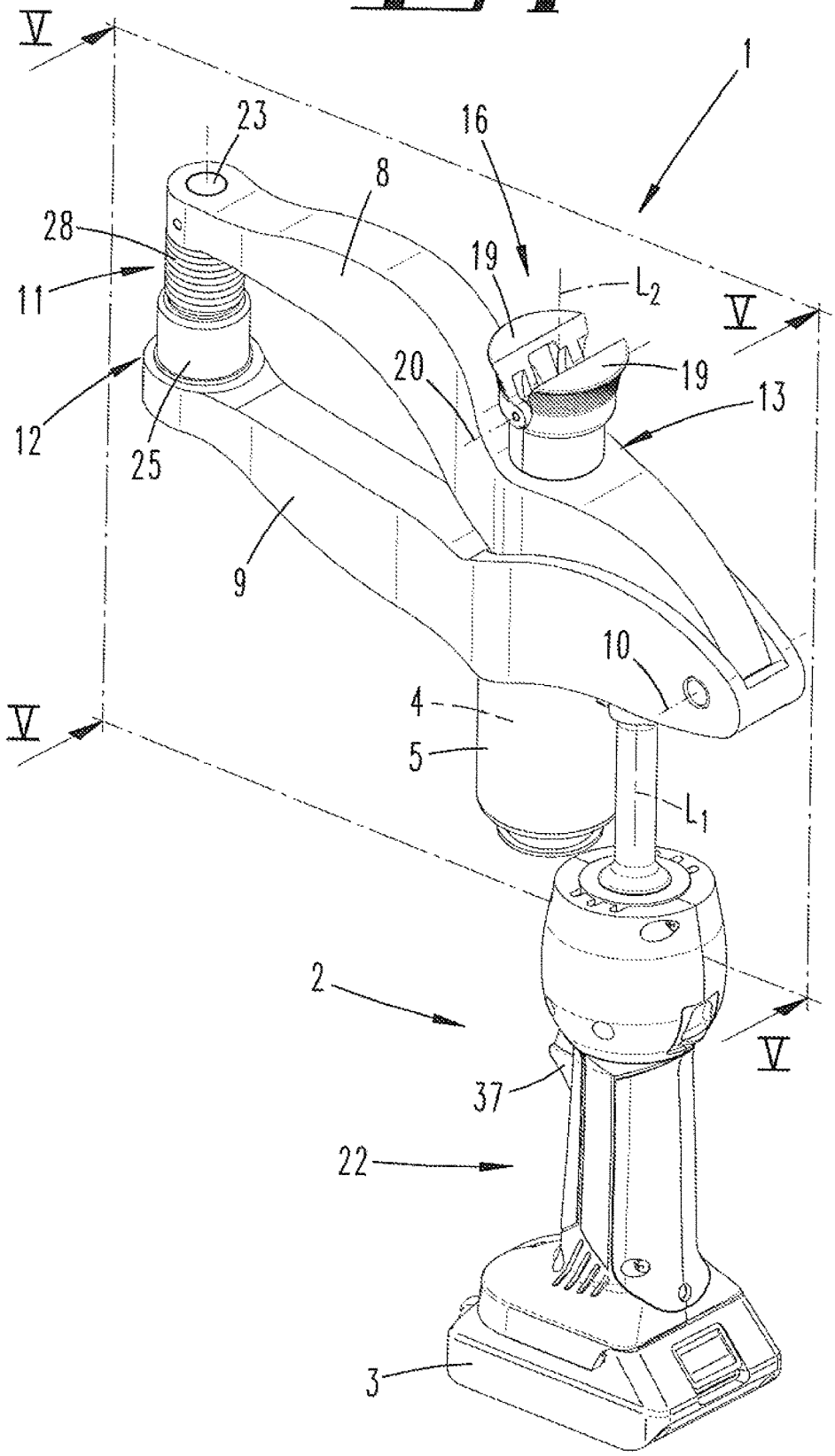
FIG. 4 is a further illustration of a corresponding handheld apparatus as per FIG. 1, in an alternative embodiment.

A handheld apparatus 1 that can be actuated by electric motor is illustrated and described initially with reference to FIGS. 1 to 3. The electric motor itself is not illustrated in detail. Said electric motor is situated in that part of the handheld apparatus 1 which can be designated as body unit 2.

Here, the body unit 2 comprises the assemblies typical for a hydraulic or pneumatic handheld tool apparatus of said type (compare also WO 03/084719 A2 and US 2007/0180887 A1). Additionally to the stated electric motor, there is preferably a battery 3, a further tank (not illustrated) for hydraulic or pneumatic medium, a (first) hydraulic or pneumatic actuator/cylinder arrangement, and a return valve for the control of said first hydraulic or pneumatic actuator/cylinder arrangement.

Furthermore, the handheld apparatus may have a tension piston 4 which is arranged in a receiving cylinder 5. The receiving cylinder 5 is, by means of a rotary joint 7, arranged so as to be hydraulic or pneumatic line 6 which actuator/cylinder arrangement which is correspondingly pressure line, by means of a rotary joint pivotable relative to a connects to the first of the body unit 2 and preferably a hydraulic or pneumatic pressure line.

The stated hydraulic or pneumatic line 6 has a first longitudinal axis $L_1$, whereas the tension piston 4, if provided and the receiving cylinder 5 have a second longitudinal axis $L_2$. As also illustrated in the exemplary embodiment, the first longitudinal axis $L_1$ and the second longitudinal axis $L_2$ preferably run parallel to one another. In the exemplary embodiment, the second longitudinal axis $L_2$ preferably continues into an axis which extends through the means of action, in this case as shown in FIGS. 1-11 as an actuator formed as a piston rod 15, and the regions of action 13 and 14, which axis can also be referred to as axis of action $L_2$. The pivoting jaws may be jointly pivotable about said axis too.

A yet further pivot axis $L_3$ preferably runs at an angle, specifically more preferably at right angles (for example in relation to a plane in which both the axis $L_1$ and/or $L_2$ and also the axis $L_3$ extend), with respect to the first longitudinal axis $L_1$ and/or the second longitudinal axis $L_2$.

In the exemplary embodiment of FIGS. 1 to 3, the pivoting jaws 8, 9, which are in the form of punching jaws, are connected to one another so as to be pivotable about a pivot axis 10. Said pivoting jaws thus pivot in a pivot plane which extends at right angles to the pivot axis 10. The pivot axis 10 that is common to both punching jaws 8, 9 is, in the exemplary embodiment of FIGS. 1 to 3, arranged behind the pivot axis 10 as viewed from working regions 11, 12 of the punching jaw.

Figure 5:
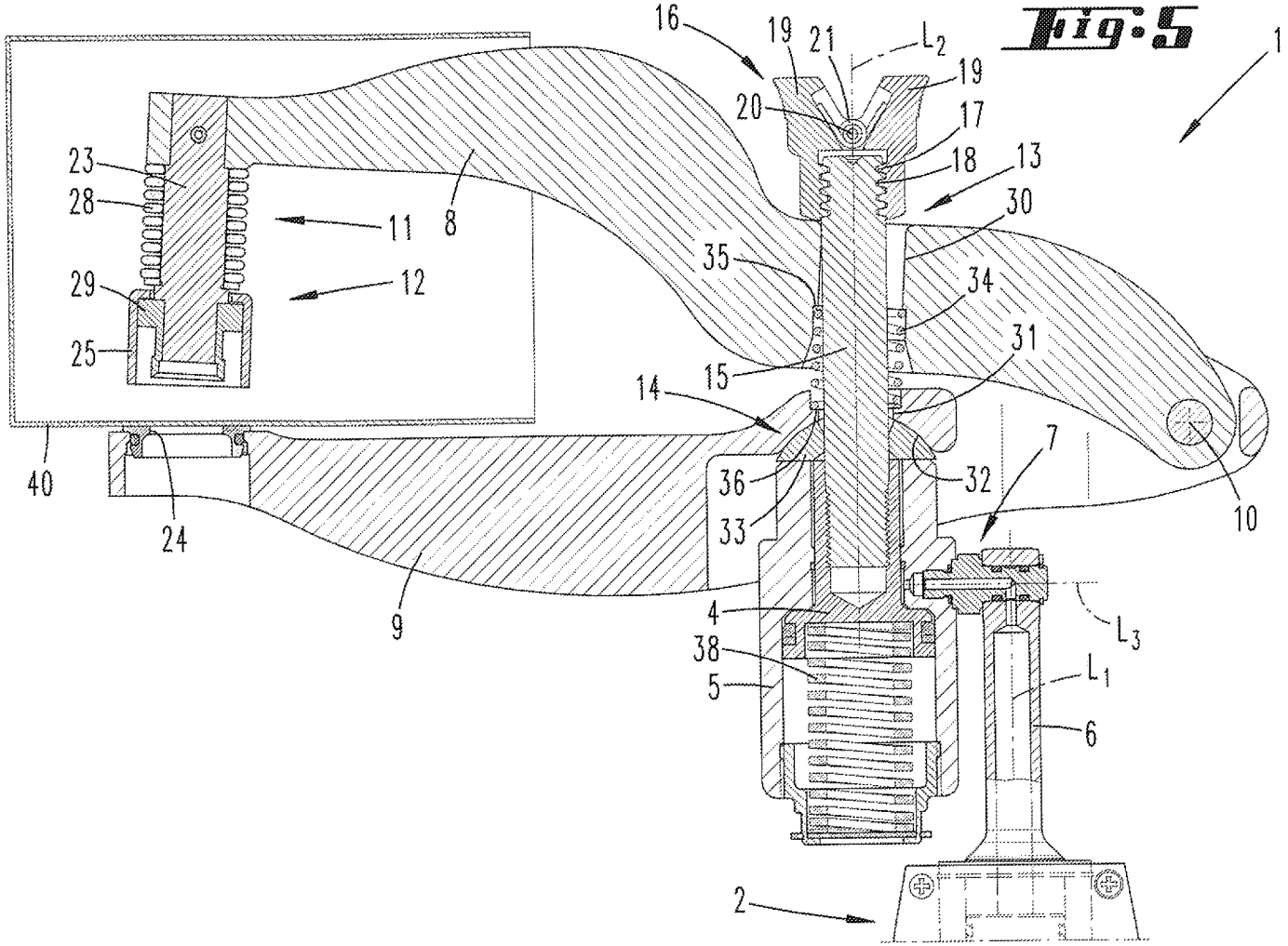
FIG. 5 shows a cross-section through the item from FIG. 4, sectioned in the plane V-V.
Figure 6:
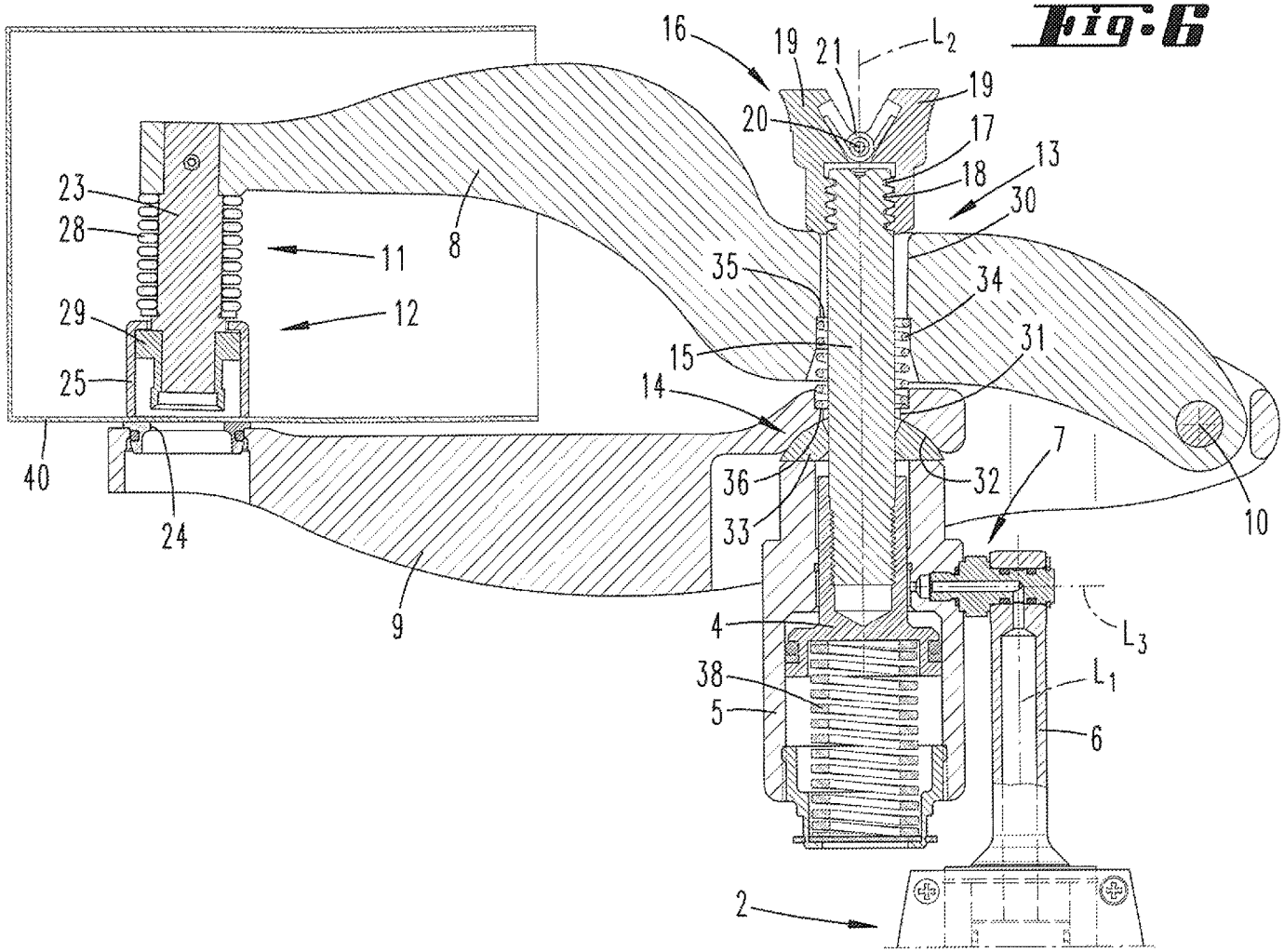
FIG. 6 is an illustration as per FIG. 5, after the pivoting jaws have been pivoted into a working position.
Figure 1:
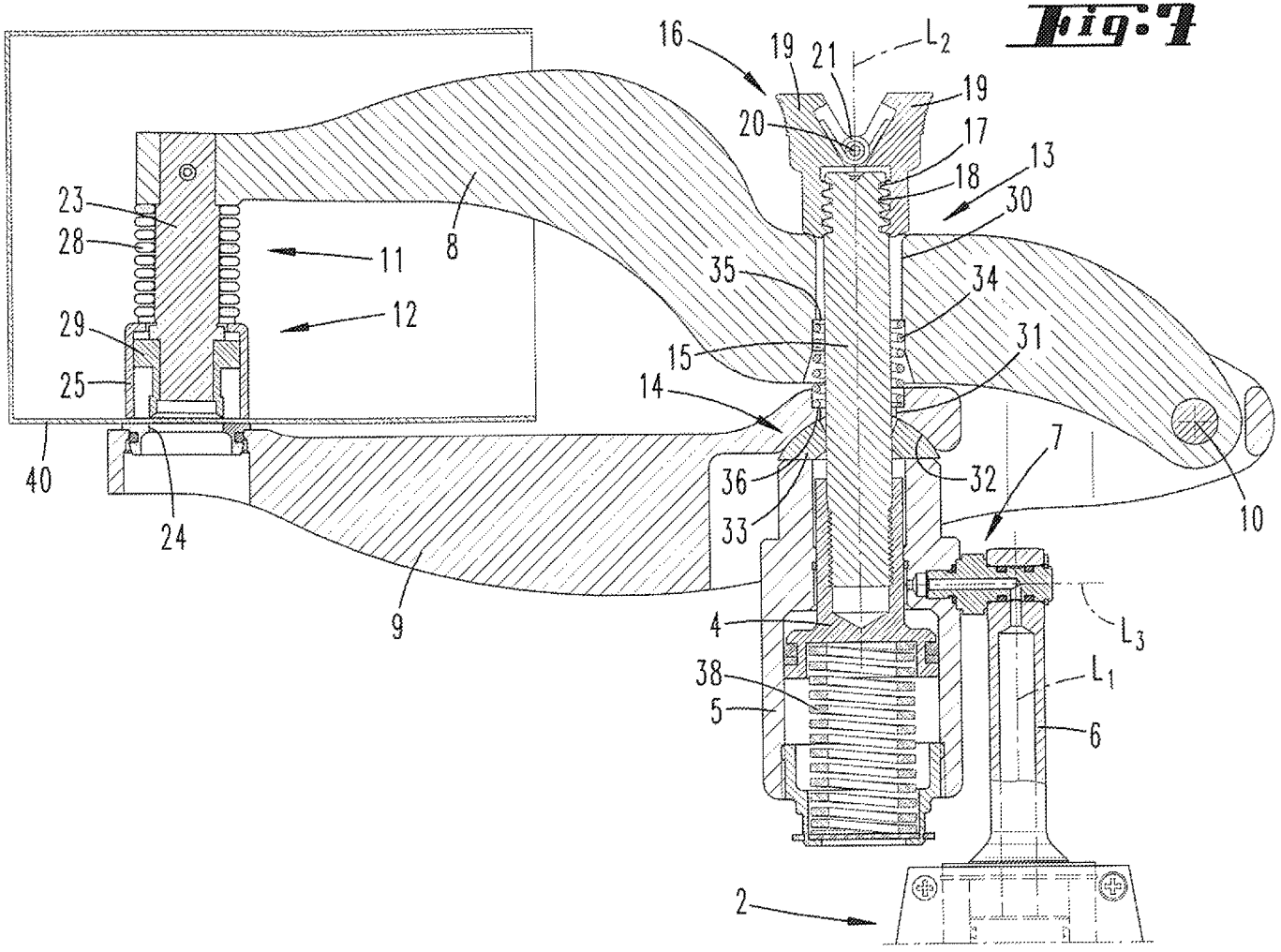
Figure 8:
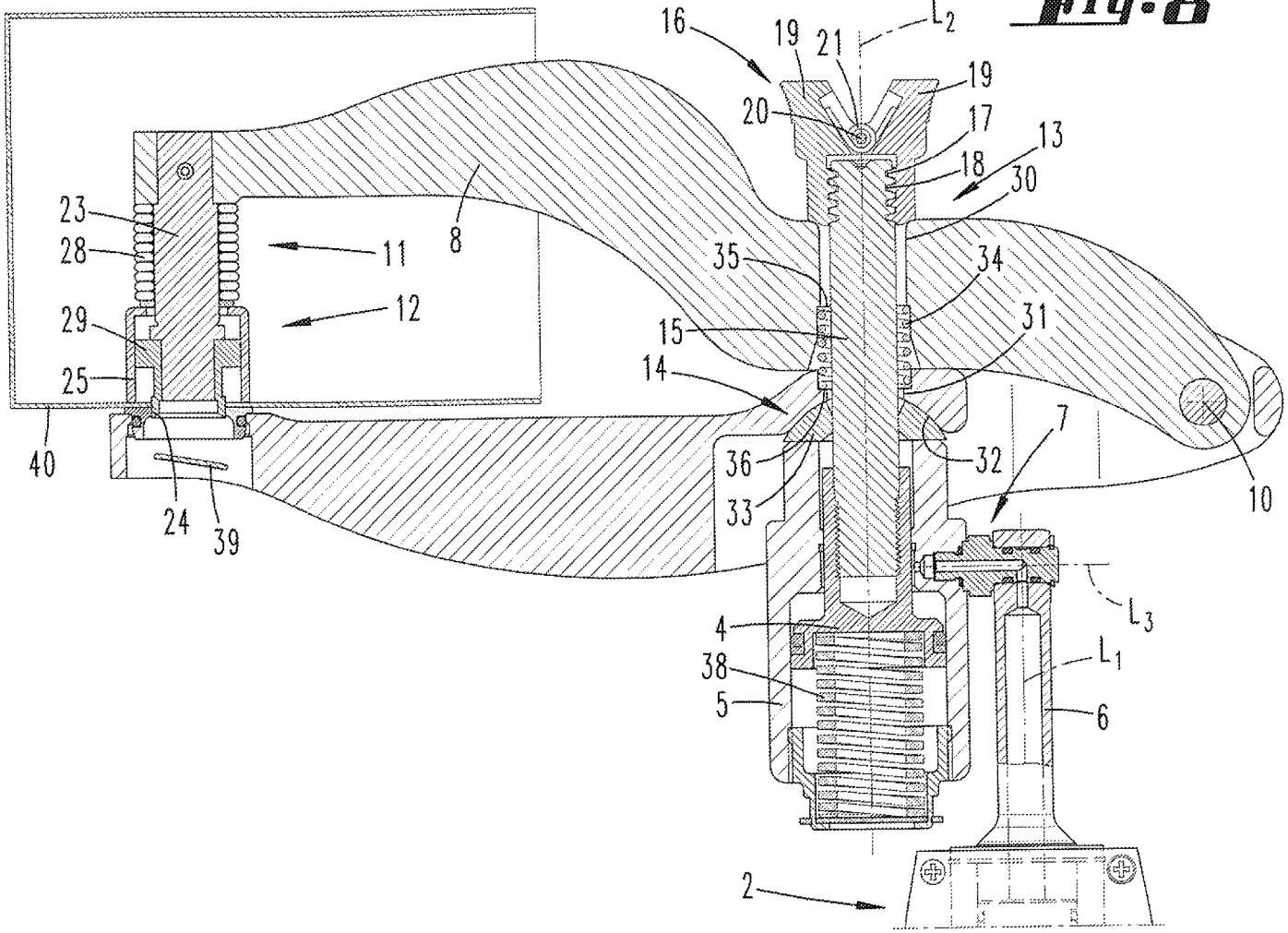
FIG. 8 is a further illustration in the sequence of FIGS. 6 and 7, after the punching-out process has taken place.

As can be seen in particular from FIGS. 2 and 3, 5 regions of action 13, 14 are formed on both punching jaws 8, 9. The piston rod 15 which is arranged as an elongation of the tension piston 4 extends through each of the regions of action 13, 14.

In a further detail, the receiving cylinder, which in it is assigned, as fixed part, to the punching jaw 8, the region of action 14 thereof, bearing as counter bracket against the region of action 14.

That end of the piston rod 15 which faces away from the tension piston 4 bears, likewise in pressure transmitting fashion, against the region of action 13 of the pivoting jaw 9

In the physical embodiment, there is provided, for this purpose, an engage-over means which interacts with the associated end of the piston rod 15. Said engage-over means is specifically a clip-like retention part 16 which engages by way of engagement teeth 17 into engagement recesses 18 of said end of the piston rod 15.

It is however embodiment, for engagement teeth preferable, as in the engagement recesses 18 to be of circularly exemplary and encircling form, without merging into one another in the manner of a thread.

It is also preferable for the retention part 16 to have two clip jaws 19 which are rotatably pivotable relative to one another about a clip axis 20. Said clip jaws are preloaded into the illustrated retention or bracing position by a spring 21.

It is preferable for the only contact between the piston rod 15 and the region of action 13 of the pivoting jaw 9 to be established via the engage-over means.

The support by the fixed part, or specifically the receiving cylinder 5, in the region of action 14, and also the support via the engage-over means, for example the retention part 16, on the region of action 13, of the pivoting jaws 8 and 9 respectively, is established in each case on the outer side of the pivoting jaws.

As can be seen, not only are the pivoting jaws 8, 9 pivotable relative to one another about the common pivot axis 10, but owing to the pivot axis $L_3$ as a further axis $L_3$ in addition to the pivot axis 10 and the second longitudinal axis or axis of action, said pivoting jaws are rotatable relative to a grip region 22, which in this respect is to be regarded as fixed and which is specifically formed on the body unit 2, of the handheld apparatus 1.

As can also be seen in a further detail from the exploded illustration of FIG. 2, one of the working regions 11, 12 of the pivoting jaws 8, 9 has a punching stamp 23, and the other has a punching opening 24.

The punching stamp 23 is surrounded by a scraper part 25 which, in the exemplary embodiment and preferably, is of sleeve-shaped form. By way of fastening means 26 and slots 27 formed in the scraper part 25, the scraper part 25 is arranged so as to be movable relative to the punching stamp 23. Said scraper part 25 is preloaded into a position in which it radially overlaps the punching stamp by means of a preload spring 28, in this regard see also FIG. 5, for example.

Furthermore, the punching stamp 23 is preferably formed, with regard to its free end, by a separate punching sleeve 29, which may furthermore be attached by way of a fastening means (not illustrated) to the punching stamp 23. In this way, it is also possible for an exchange to be carried out in an extremely simple manner.

In the embodiment of FIGS. 4 to 8, the means of action act on the pivoting jaws 8, 9 between the working regions 11, 12 and the pivot axis 10 as viewed with respect to a longitudinal extent of the pivoting jaws 8, 9.

Said longitudinal extent of the pivoting jaws is the extent of the pivoting jaws in the direction from the working regions 11, 12 to the pivot axis 10 and, if appropriate, beyond (see the first embodiment).

In this case, too, the means of action together with the pivoting jaws 8, 9 utilizing openings 30, 31 which are formed in said pivoting jaws 8, 9 and which are oriented toward one another. The means of action are also formed so as to be substantially identical to the means of action already described with regard to the first embodiment of FIGS. 1 to 3.

As can be seen, the openings 30, 31 in the second embodiment are also preferably provided with a slightly larger diameter in order thereby to allow or permit a relative movement of the means of action, in particular of the piston rod 15, relative to the openings 30, 31 to a slightly greater extent.

It is the case in this embodiment, although it is basically also possible in the first embodiment described, that the fixed part of the means of action, the receiving cylinder 5, acts by way of a spherical-cap part 33, which has a spherical-cap section 32, on the associated pivoting jaw, in this case the pivoting jaw 9. The associated region of action of the pivoting jaw 9 is of concave form. It would also be possible for a separate part, which has (only) the concave form, to be provided.

As is basically also possible with regard to the first embodiment, the pivoting jaws 8, 9 are furthermore preloaded into their open position by means of a restoring spring 34. Whereas the restoring spring 34 is, in the exemplary embodiment and preferably, a compression spring, said restoring spring would in this respect be, in the first embodiment, a tension spring which acts on the pivoting jaws. Furthermore, in the exemplary embodiment and preferably, the restoring spring 34 surrounds the piston rod 15. Shoulders 35, 36 are formed in those regions of the pivoting jaws 8, 9 which face toward one another, on each of which shoulders the restoring spring 34 is supported.

To perform a punching process, such as is illustrated in detail in the sequence of FIGS. 5 to 8, a start-up of the electric motor is triggered by means of a hand-operated switch 37 in the body unit 2, resulting in hydraulic or pneumatic medium being pumped into a first hydraulic or pneumatic cylinder 5 by means of a hydraulic or pneumatic pump and a first hydraulic or pneumatic piston being moved, which hydraulic or pneumatic piston introduces hydraulic or pneumatic medium under pressure into the receiving cylinder 5 via the hydraulic line 6. Since the hydraulic or pneumatic medium is introduced into the receiving cylinder 5 at the top side, in the exemplary embodiments at the side of the pivoting jaw, of the tension piston 4 (see the stated figures), it is the case in the illustrated basic position of the apparatus (though, owing to a pivoting capability about the pivot axis $L_3$, said basic position need not imperatively have been assumed) that the tension piston 4/piston rod 15 moves in the direction of the body unit 2. Here, the movement takes place counter to a restoring spring 38. As a result of said movement, the piston rod 15 is pulled (further) into the receiving cylinder 5, and thus the pivoting jaws 8, 9 are, at the working region side, moved toward one another in order to perform a working process. In the case of the illustrated pivoting jaws 8, 9, the movement is possible to such an extent that a punched-out part 39 is punched out of a sheet-metal part 40 which in this case, is illustrated as being of tubular form, for example.

Since it is the case here that the already discussed preload spring 28 is compressed at the same time, a restoring movement of the scraper part 25 relative to the punching stamp 23 takes place during a subsequent relaxation of the tension piston 4/piston rod 15, which can be achieved by means of a return flow of hydraulic or pneumatic medium into a hydraulic or pneumatic medium storage tank, by means of which restoring movement a sheet-metal part 40 that may, for example, still be connected by clamping to the punching stamp 23 is scraped off.

Figure 9:
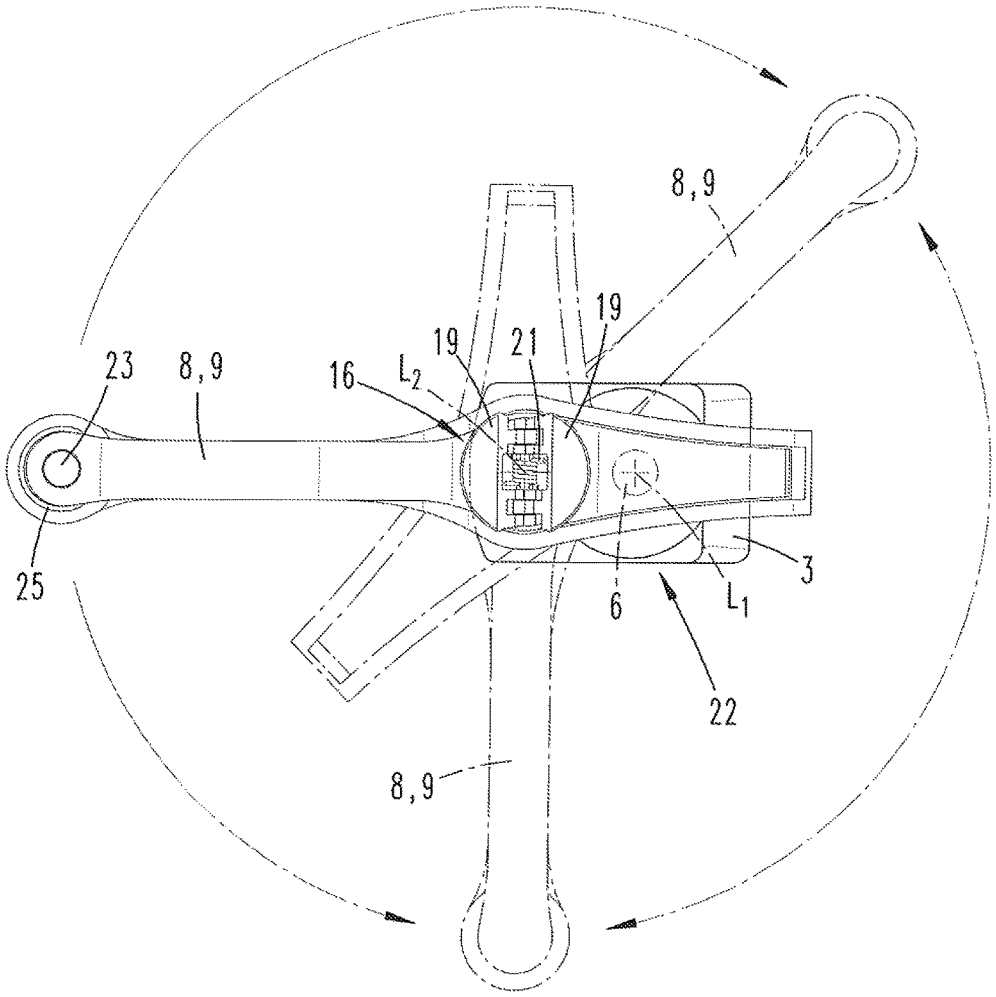
FIG. 9 shows a view from above in the direction of a longitudinal axis of the means of action, in order to illustrate the pivoting capabilities about a longitudinal axis of the handheld apparatus.

With reference to FIG. 9, it can be seen that the pivoting jaws 8, 9 are firstly pivotable about the second longitudinal axis $L_2$ in the illustrated plan view, but are also pivotable about the first longitudinal axis $L_1$, and are furthermore pivotable about the pivot axis $L_3$, see the illustrations of FIGS. 1, 3 and 5 to 8.

Since the pivoting about the first and second longitudinal axes $L_1$, $L_2$ permits rotational pivoting about a longitudinal axis of the hydraulic or pneumatic cylinder in the body unit 2 and of the receiving cylinder 5, the pivoting about the pivot axis $L_3$ permits pivoting of the pivoting jaws 8, 9 together with receiving cylinder 5 and the tension piston 4/piston rod 15 situated therein on a circular path, the central point of which is formed by the stated pivot axis $L_3$.

Figure 10:
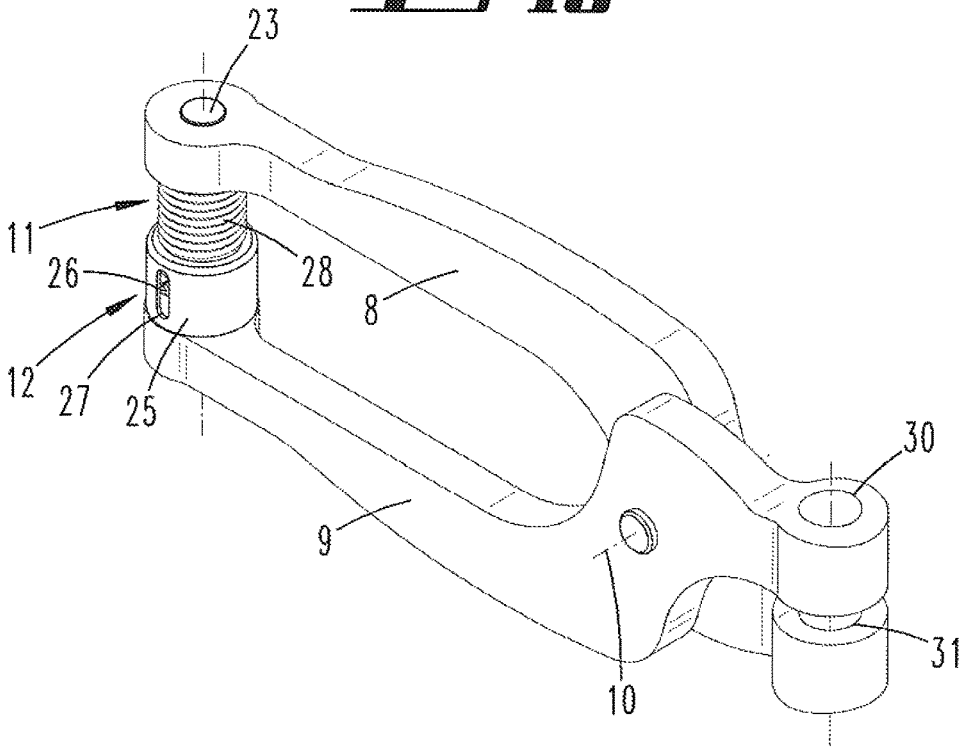
FIG. 10 is a detail illustration of the pivoting jaws in the embodiment of FIG. 1.
Figure 11:
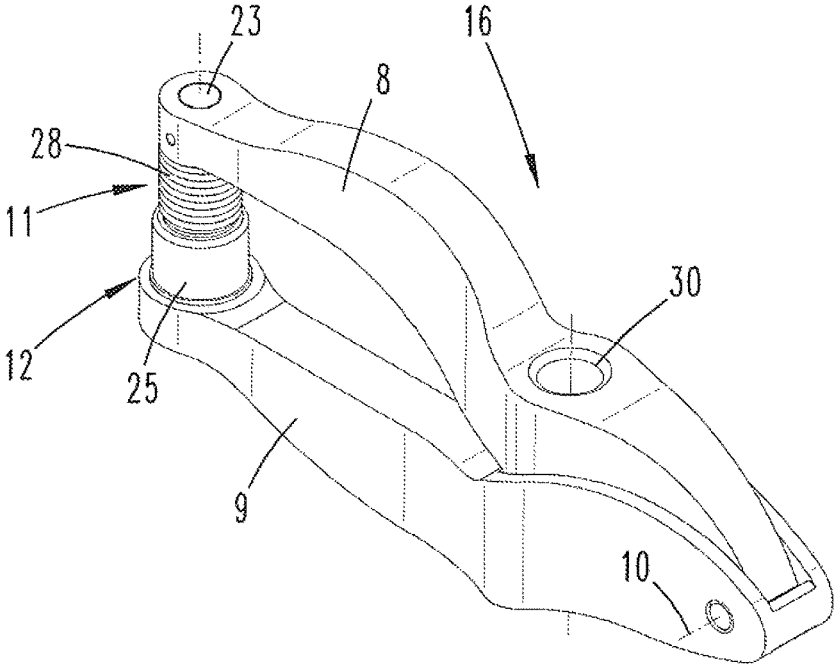
FIG. 11 is a detail illustration of the pivoting jaws in the embodiment of FIG. 4.

FIGS. 10 and 11 each show the pivoting jaw pairs, embodied in this case as punching jaws, in a detail illustration without the associated handheld apparatus. Said pivoting jaw pairs are also an independent subject of the application, and may basically be connected to any suitable handheld apparatus.

With regard to the description of details, reference is made to the description above.

The above statements serve to explain the inventions encompassed overall by the application, which inventions each independently constitute refinements of the prior art at least by way of the following combinations of features:

A handheld apparatus which is characterized in that the regions of action 13, 14 of the pivoting jaws 8, 9 can be moved toward one another in order for a punching process to be performed.

A handheld apparatus which is characterized in that the pivoting jaws 8, 9 are jointly rotatable, about a further axis $L_3$ which differs from the axis of action $L_2$, relative to the grip region 22 which is to be regarded as static.

A handheld apparatus or pivoting jaws which are characterized in that the pivoting jaws 8, 9 extend so as to cross one another.

A handheld apparatus or pivoting jaws which are characterized in that, for interaction with a means of action, the pivoting jaws 8, 9 have openings 30, 31 which are oriented toward one another and the orientation of which corresponds to the pivot plane.

A handheld apparatus or pivoting jaws which are characterized in that the means of action act on the pivoting jaws 8, 9 between the working regions 11, 12 and the pivot axis 10 as viewed in relation to longitudinal extent of the pivoting jaws 8, 9.

A handheld apparatus or pivoting jaws which are characterized in that the means of action have a piston rod 15 which extends through both pivoting jaws 8, 9.

A handheld apparatus or pivoting jaws which are characterized in that the pivoting jaws 8, 9 are pre-loaded into their initial position by means of a restoring spring 34.

A handheld apparatus characterized in that or pivoting jaws which are the restoring spring 38 is arranged so as to surround the piston rod 15.

A handheld apparatus or pivoting jaws which are characterized in that, when the pivoting jaws 8, 9 are acted on in order to perform a working process, the fixed part of the means of action interacts, as counter bracket, with one of the pivoting jaws 8, 9.

A handheld apparatus or pivoting jaws which are characterized in that the fixed part, in the form of a counter bracket, acts via a spherical-cap section 32 on a suitably concavely formed action section of the associated pivoting jaw 8, 9 so as to realize an articulated movement capability.

Figure 12:
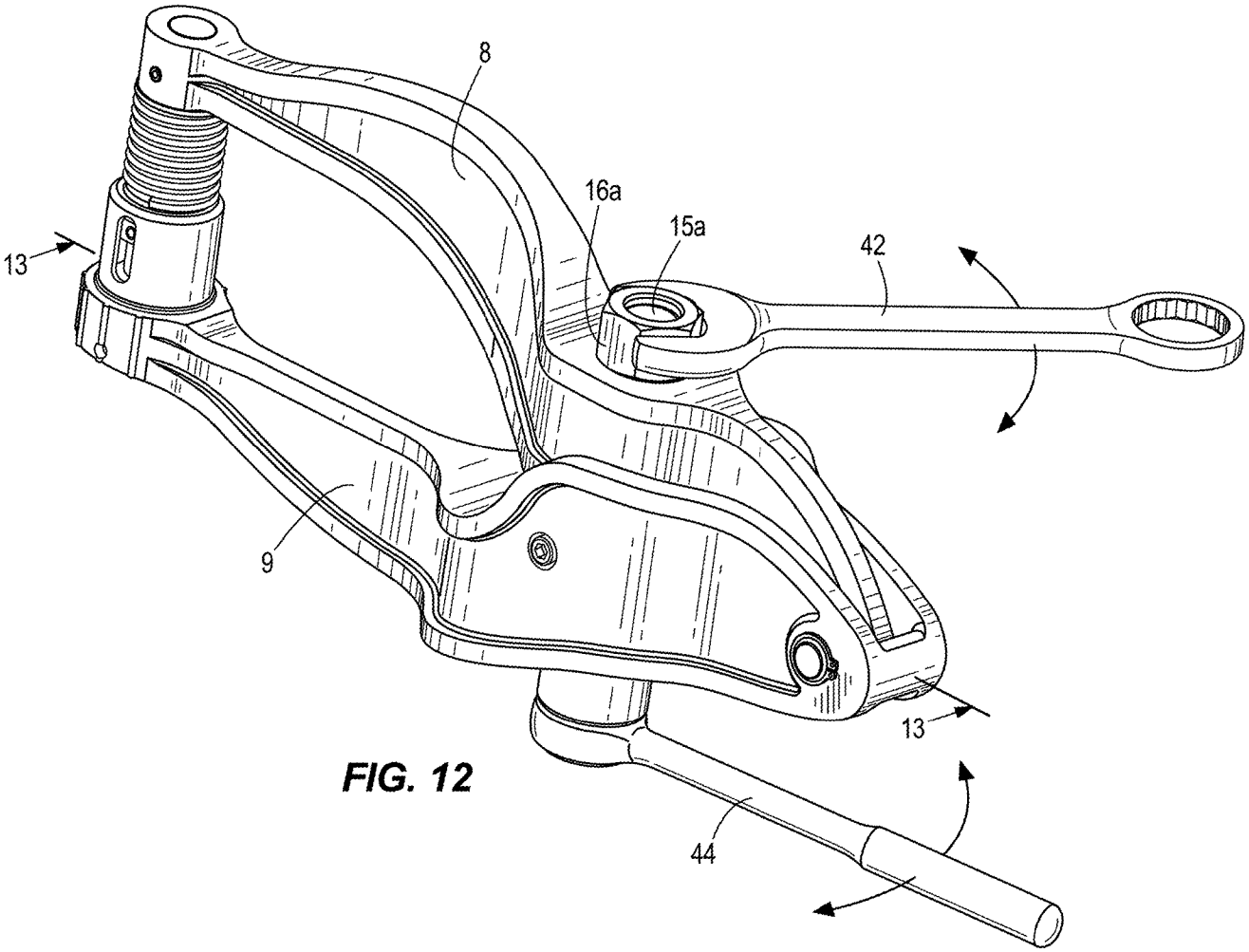
FIG. 12 is a perspective view of a handheld apparatus connected to pivoting jaws in the form of punching jaws.
Figure 13:
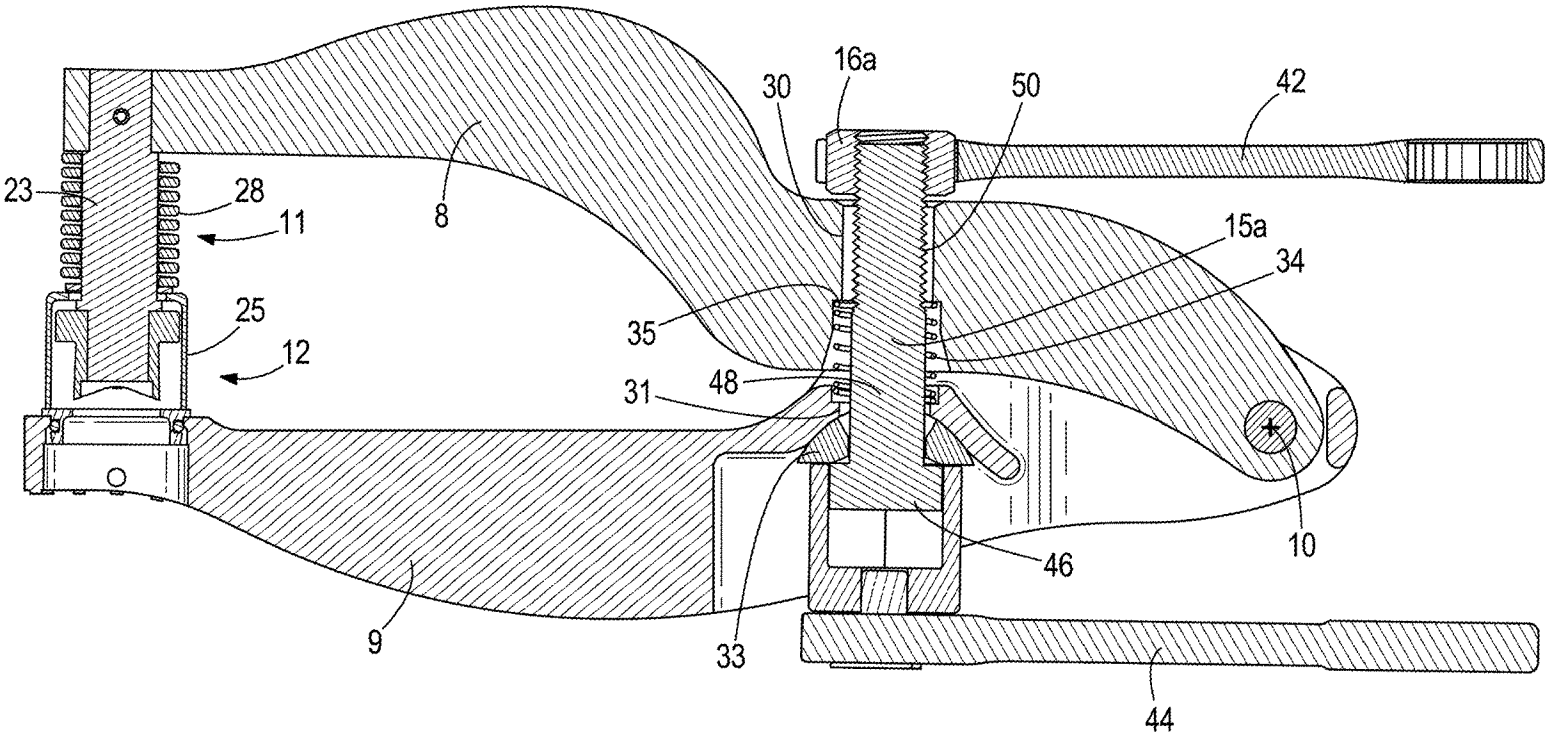
FIG. 13 is a cross-section of the handheld apparatus of FIG. 12.

As shown in FIGS. 12 and 13, the piston rod 15 in FIG. 5 has been replaced with piston rod 15*a*, the retention part 16 has been replaced with a nut 16*a* and a hand-held wrench 42 which engages the nut 16*a*, and the body unit 2 has been replaced by a hand-held socket wrench 44 which engages the piston rod 15*a*.

Piston rod 15*a* has a head 46 at one end of an elongated shank 48, and a conventional thread form 50 at the other end of the shank 48. The head 46 engages the spherical cap part 33 and the shank 48 seats within the openings 30, 31 which are formed in said pivoting jaws 8, 9. The threaded end of the shank 48 extends outwardly from the jaw 8 and the nut 16*a* is attached thereto and may engage against jaw 8.

To perform a punching process, the user holds the wrench 42 to hold the nut 16*a*, and thus the piston rod 15*a* stationary. The user engages the socket wrench 44 with the head 46 of the piston rod 15*a* and rotates the socket wrench 44 in a known manner. This causes the piston rod 15*a* to travel relative to the stationary nut 16*a* and to move in the direction of the toward the socket wrench 44. As a result of said movement, the pivoting jaws 8, 9 are, at the working region side, moved toward one another in order to perform a working process. In the case of the illustrated pivoting jaws 8, 9, the movement is possible to such an extent that a punched-out part is punched out of a sheet-metal part which in this case, is illustrated as being of tubular form, for example. Since it is the case here that the already discussed preload spring 28 is compressed at the same time, a restoring movement of the scraper part 25 relative to the punching stamp 23 takes place during a subsequent return of the piston rod 15*a* to its more fully seated position within the nut 16*a*, by means of which restoring movement a sheet-metal part that may, for example, still be connected by clamping to the punching stamp 23 is scraped off.

While this embodiment is shown with respect to the embodiment shown in FIGS. 5-9, the piston rod 15*a*, nut 16*a*, hand-held wrench 42 and socket wrench 44 can be used with the embodiment shown in FIGS. 1-4. With the embodiment shown in FIGS. 1-4, the head 46 of the piston rod 15*a* would engage directly with the jaw 8.

All of the disclosed features are (independently but also in combination with one another) essential to the invention. The content of disclosure of the associated/appended priority documents (copy of the prior application) is hereby also incorporated in its entirety into the disclosure of the application, also for the purpose of incorporating features from said documents in claims of the present application. The subclaims, by way of their features, characterize independent inventive refinements of the prior art, in particular for the purpose of filing divisional applications on the basis of said claims.

LIST OF REFERENCE SIGNS

1 Handheld apparatus
2 Body unit

3 Battery
4 Tension piston
5 Receiving cylinder
6 Hydraulic or pneumatic line
7 Rotary joint
8 Pivoting jaw
9 Pivoting jaw
10 Pivot axis
11 Working region
12 Working region
13 Region of action
14 Region of action
15 Piston rod
**15*a*** Piston rod
16 Retention part
**16*a*** Nut
17 Engagement tooth
18 Engagement recess
19 Clip jaw
20 Clip axis
21 Spring
22 Grip region
23 Punching stamp
24 Punching opening
25 Scraper part
26 Fastening means
27 Slot
28 Preload spring
29 Punching sleeve
30 Opening
31 Opening
32 Spherical-cap section
33 Spherical-cap part
34 Restoring spring
35 Shoulder
36 Shoulder
37 Hand-operated switch
38 Restoring spring
39 Punched-out part
40 Sheet-metal part
42 Hand-held wrench
44 Hand-held socket wrench
46 Head
48 Shank
50 Thread form
$L_1$ First longitudinal axis
$L_2$ Second longitudinal axis
$L_3$ Pivot axis

What is claimed is:

1. An assembly comprising:

a first punching jaw having a first end and a second end, the first punching jaw having an opening therethrough at the second end;

a second punching jaw having a first end and a second end, the first and second punching jaws being pivotally connected together and configured to pivot in a pivot plane about a common pivot axis between an open position and a punching position;

a first spring engaged with each punching jaw, wherein the first spring is configured to move the punching jaws to the open position;

a punching stamp provided on the first end of one of the punching jaws and a punching opening provided on the first end of the other of the punching jaws; and a handheld apparatus connected to the first and second jaws comprising a rod having a first end and a second end, the rod extending through the opening in the first jaw, the second end of the rod being attached to the second punching jaw, a cylinder attached to the first end of the rod and bearing against the first punching jaw, the rod extending into the cylinder, and a second spring within the cylinder, the second spring bearing against the rod, wherein responsive to introduction of a hydraulic or pneumatic medium under pressure into the cylinder, the first ends of the punching jaws move toward each other to the punching position to affect a punching process and the rod is moved further into the cylinder, wherein movement of the rod takes place counter to a biasing force of the first and second springs, and compresses the first and second springs.

2. The assembly of claim 1, wherein said handheld apparatus is linearly actuated on an actuation axis which is angled relative to the pivot axis.

3. The assembly of claim 2, wherein the actuation axis is perpendicular to the pivot axis.

4. The assembly of claim 1, wherein the pivot axis is provided between the first end of the punching jaws and the rod.

5. The assembly of claim 1, wherein the pivot axis is between the rod and the second ends of the punching jaws.

6. The assembly of claim 1, wherein the handheld apparatus includes a spherical-cap section, and the second punching jaw includes a concave pocket into which the spherical-cap section seats.

7. The assembly of claim 6, wherein the rod extends through the spherical-cap section.

8. The assembly of claim 1, wherein the punching jaws extend so as to cross one another.

9. The assembly of claim 1, wherein the handheld apparatus comprises a gripping region and a user's hand can grip the gripping region to hold the handheld apparatus.

10. The assembly of claim 1, wherein the second end of the rod extends through an opening in the second punching jaw, and the second end of the rod is attached to the second punching jaw by a retaining member engaged with the second end of the rod and bearing against the second punching jaw.

11. The assembly of claim 10, wherein the retaining member comprises a removable clip.

12. The assembly of claim 11, wherein the rod has engagement recesses, and the clip has teeth thereon, the teeth engaging within the engagement recesses on the rod.

13. The assembly of claim 1, wherein the second end of the rod extends through an opening in the second punching jaw, and the rod comprises a head and a shank extending therefrom, the second end of the rod is attached to the second punching jaw by the head bearing against the second punching jaw.

14. The assembly of claim 1, wherein the first spring surrounds the rod.

15. The assembly of claim 1, further comprising a scraper part mounted on the punching stamp, a third spring mounted on the punching stamp and provided between the scraper part and the first end of the punching jaw on which the punching stamp provided, the third spring biasing the scraper part into a position which radially overlaps the punching stamp, the third spring acting in a same direction as the first and second springs.

16. An assembly comprising:

a first punching jaw having a first end and a second end, the first punching jaw having an unthreaded opening formed by a wall therethrough;

a second punching jaw having a first end and a second end, the second punching jaw having an unthreaded opening formed by a wall therethrough, the first and second punching jaws being pivotally connected together and configured to pivot in a pivot plane about a common pivot axis between an open position and a punching position, the openings in the first and second punching jaws aligning with each other and aligning with the pivot plane;

a spring engaged with each punching jaw, wherein the spring is configured to move the punching jaws to the open position;

a punching stamp provided on the first end of one of the punching jaws and a punching opening provided on the first end of the other of the punching jaws; and a handheld apparatus comprising a spherical-cap part engaged with the first punching jaw, the spherical-cap part having an opening therethrough, a rod comprising a shank having first and second opposite ends and a head at the first end of the shank, the shank defining a longitudinal axis of the rod, the shank having a dimension transverse to the longitudinal axis of the rod, the shank extending through the unthreaded openings in the first and second punching jaws and through the opening in the spherical-cap part, the opening in the first punching jaw defining a dimension transverse to the longitudinal axis of the rod which is larger than the dimension of the rod such that a space is formed between the rod and the wall forming the opening in the first punching jaw, the opening in the second punching jaw defining a dimension transverse to the longitudinal axis of the rod which is larger than the dimension of the rod such that a space is formed between the rod and the wall forming the opening in the second punching jaw, the head engaging the spherical-cap part and being larger than the opening through the spherical-cap part such that the head cannot pass through the opening through the spherical-cap part, a wrench connected to the first end of the rod, the wrench being a separate component from the jaws and removable from the first end of the rod, and a nut threadedly attached to the second end of the rod and configured to engage the second punching jaw, the nut being larger than the opening through the second punching jaw such that the nut cannot pass through the opening through the second punching jaw, the nut being a separate component from the jaws and removable from the second end of the rod, wherein the rod and the nut are freely rotatable around the longitudinal axis of the rod when the wrench is not attached to the first end of the rod, and wherein when the nut is held stationary and when the wrench and rod are rotated together relative to the nut, the punching jaws and the spherical-cap part, at least one of the punching jaws moves in response such that the first ends of the punching jaws move toward each other to affect a punching process.

17. The assembly of claim 16, wherein during a punching process the punching stamp passes through the punching opening.

* * * * *